United States Patent [19]

Woodford

[11] 4,297,008

[45] Oct. 27, 1981

[54] METHOD AND APPARATUS FOR MAKING A NON SPHERICAL BEVELED CONTACT LENS

[76] Inventor: Donald L. Woodford, 9925 Broadmoor Dr., Omaha, Nebr. 68114

[21] Appl. No.: 3,833

[22] Filed: Jan. 16, 1979

[51] Int. Cl.[3] ..... B24B 9/14; G02C 7/04

[52] U.S. Cl. ..... 351/177; 61/124 L; 351/160 R

[58] Field of Search ..... 351/160–162, 351/177; 51/124 L

[56] References Cited

U.S. PATENT DOCUMENTS

| | | | |
|---|---|---|---|
| 3,187,338 | 6/1965 | Neefe | 351/160 |
| 3,227,507 | 1/1966 | Feinbloom | 351/160 |
| 3,283,446 | 11/1966 | Feinbloom | 51/284 |
| 3,482,906 | 12/1969 | Volk | 351/160 |
| 3,535,825 | 10/1970 | Volk | 351/160 |
| 3,871,813 | 3/1975 | Cappeli | 350/160 R X |

*Primary Examiner*—John K. Corbin
*Assistant Examiner*—Scott J. Sugarman
*Attorney, Agent, or Firm*—William D. West

[57] ABSTRACT

An improved contact lens with a truly non-spherical bevel is disclosed, along with a method and apparatus for making same. Lenses, including the theoretically perfect "ski" periphery are consistently produced and reproduced by bringing the posterior surface of the unfinished lens into contact with a rotating abrasive coated working surface. The working surface or tool is size selected to match the unfinished lens and desired fitting dimensions. The working surface is formed on a tool body having a central axis and having a smooth three-dimensional curvilinear surface configuration generated by the rotation of an S-shaped curve produced by the circumferential arcs of two tangential conic-section curves about the central axis.

5 Claims, 12 Drawing Figures

METHOD AND APPARATUS FOR MAKING A NON SPHERICAL BEVELED CONTACT LENS

BACKGROUND OF THE INVENTION

This invention relates generally to contact lenses, and particularly to an improved lens and method and apparatus for making same.

The design, development and production of contact lenses are representative activities of the class of so-called "high technology" industries. The research competition for improved materials and techniques is very keen and large sums of monies are expended each year by companies to insure that their abilities are better than, or commensurate with, others in the market place. The instant invention is concerned not with materials, but rather the production of improved lenses.

The ideal end product in this art is one which is not only comfortable to wear for extended periods of time, but also easily manufactured at minimum cost in time and labor. Importantly, any specific lens fitting characteristics should also be readily reproducable in a consistent manner to satisfy the requirements of the replacement buyer.

Early corneal contact lenses, i.e., lenses designed and fitted to cover only the corneal region of the eye, while being revolutionary in concept, nonetheless displayed a number of disadvantages which were later overcome as technology improved. The cornea of the eye is not truly spherical edge to edge, but is so only in its central portion. From the edge of the central position outwardly toward the limbal area, the curvature of the cornea flattens or its radius increases. If a lens having a curvature parallel with the central portion of the cornea is used, the edges of the lens will rest on the peripheral cornea, shutting off circulation and free flow of lachrymal fluids and also hindering the cornea from obtaining oxygen from the atmosphere, both of which are necessary for lens tolerance. In the absence of the free circulation of oxygen and oxygen enriched fluids between the lens and the eye, there is a veiling and fogging of vision, and the wear time is greatly limited. If a lens with a base curve or inside curvature flatter than the curve of the actual portion of the cornea and of sufficient length to provide the required inside contour to clear the limbal cornea area is used, such a lens will rest on the apex of the cornea thus exerting pressure which will temporarily flatten the cornea. Aside from producing a temporary blurred vision, this latter arrangement allows little capillary attraction and may not remain in position possibly resulting in corneal abrasions and ulcerations.

To overcome the above-described problems, the most successful modern contact lenses are produced with the base curve slightly steeper than the central corneal curves and with the posterior surface near the edge flatter than the base curve. This special edge treatment is intended to creat an ideally positioned reservoir for oxygen enriched tears to collect, ready to flow under the lens when it is set in motion by a blink of the eye. This area was referred to in early literature as a "chamfer", but is now referred to as a "bevel".

It is well accepted that the ideal bevel configuration resembles a ski tip; hence, reference is often made to the "ski" bevel. Prior to the instant invention, the "ski" bevel (see FIG. 1) was merely the theoretical ideal toward which all manufacturers directed their efforts.

Present conventional bevels are produced by grinding the posterior surface of an unfinished lens at its periphery with revolving, spherical tools which have surface curvatures flatter than the base curve of the lens. Actually, a series of tools, each tool having a progressively flatter curve, is used in an attempt to "blend" the work together into a surface as smooth as possible. The process is generally viewed as a simple one. It is accomplished by using uncomplicated equipment consisting of a motor driven spindle, a polishing pot to contain the spray of polish, and a few interchangeable beveling tools. With this equipment which occupies less than two square feet of table space, one can bevel and finish contact lenses. It is important to note that the same basic equipment and techniques are used by all contact lens manufacturers.

Production of the ideal bevel has been a major problem for the contact lens industry since the beginning. The problem has been how to best produce a uniformly shaped beveled surface with spherical beveling tools. The prior art system normally does not result in controllable, smoothly beveled surfaces. Instead the majority of lenses that are produced have had irregularly beveled surfaces, representing infinite variations of wavy surface configurations. This has been proven through the random evaluation of the lenses in the field with a profile analyzer or by using the reflection from an illuminated fluorescent light source. In fact, previous literature on the subject has encouraged fitters to inspect the lenses they receive for bevel irregularities.

Referring to FIG. 3*a*, it can be seen that grinding a bevel with a single, spherical tool creates a sharp junction 32 dividing the lens base curve 30 and the bevel 34. Early clinical experience proved this to be a serious lens defect. In order to correct this condition, mid-range tool must be selected and employed to grind down the sharp juncture. This is called blending. However, this step results in the creation of two new junctures of lesser magnitude which now must be ground down, so, the process is repeated with other tools in an attempt to obtain a uniformly curved surface. See, for example, FIGS. 3*b*, through 3*d*, where the process of grinding successive curves 36, 42 and 44 results in the creation of junctures 46, 48, 50 and 52. Beveling, then, has been basically a step-by-step procedure of trying to make the interfacial curve and junctions as small and uniform as possible.

Theoretically, the step-by-step beveling process of using a series of progressively flatter tools seems to be practical enough to do an adequate job, and it probably would be, if it were not for other elements that caused serious problems and poor end results.

First, selecting the proper number of tools and radii for each lens base curve is one thing, but determining the exact grinding time with each tool is another. Secondly, the precise grinding pressure cannot be determined even by the most skilled technician. In manufacturing, it is these uncontrollable variables together with the other things mentioned that result in a beveling system which produces entirely unsuitable lens characteristics, such as exemplified at 22 in FIG. 2.

In summary, the conventional beveling process exhibits many serious drawbacks, including: (a) the beveled surfaces cannot be adequately controlled, (b) the majority of lenses manufactured have serious beveled defects, especially sharp junctions and wavy interfaces, (c) the topography of the beveled surface cannot be duplicated in the event of a lost lens, and (d) the slope of the bevel which determines the volume of the tear reservoir cannot be adequately controlled.

SUMMARY OF THE INVENTION

It is a feature of the instant invention to provide an improved contact lens which in cross section exhibits a bevel resembling the tip of a ski.

It is another feature of the instant invention to provide a contact lens with an improved bevel configuration which eliminates wear and fitting problems attributable to bevel surface irregularities.

It is another feature of the instant invention to provide an improved contact lens which overcomes the above-mentioned problems encountered by the prior art.

It is another feature of the instant invention to provide apparatus for creating a non-spherical bevel on a contact lens.

It is a further feature of the instant invention to provide novel apparatus, including a novel rotatable working surface, for forming a "ski" bevel on a contact lens.

It is a still further feature of the instant invention to provide a method for forming a non-spherical bevel on a contact lens.

It is an even still further feature of the instant invention to provide a novel method of forming a "ski" bevel on a lens by bringing the posterior surface of the lens into contact with a rotating working surface of unique design.

These and other features and objects are attained according to the instant invention by providing a novel contact lens with a truly non-spherical bevel and a method and apparatus for making same. Lenses, including the theoretically perfect "ski" periphery are consistently produced, and reproduced by bringing the posterior surface of the lens blank into contact with a rotating abrasive coated working surface. The working surface, or tool, is size selected to match the lens and desired fitting dimensions.

Further, the working surface is formed on a tool body with a central axis and having a smooth, three-dimensional curvilinear surface configuration generated by the rotation of an S-shaped curves produced by the circumferential arcs of two tangential conic-section curves about the central axis.

BRIEF DESCRIPTION OF THE DRAWINGS

The advantages of this invention will become apparent upon consideration of the following detailed disclosure of the invention, especially when taken in conjunction with the accompanying drawings wherein.

DESCRIPTION OF THE PREFERRED EMBODIMENT

Figure 1:
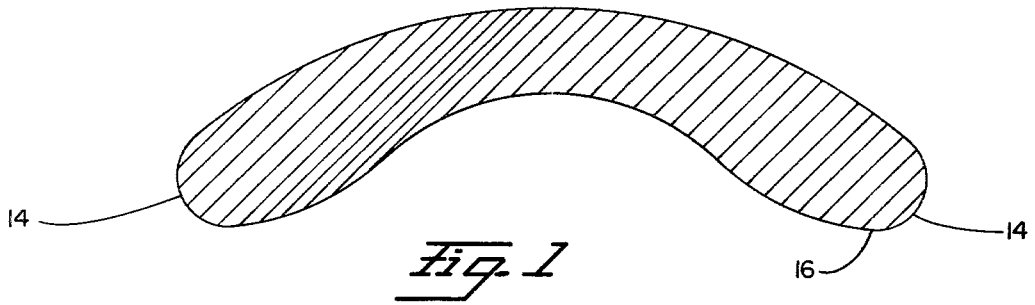
FIG. 1 is a partially schematic, cross-sectional view of contact lens into the instant invention.
Figure 2:
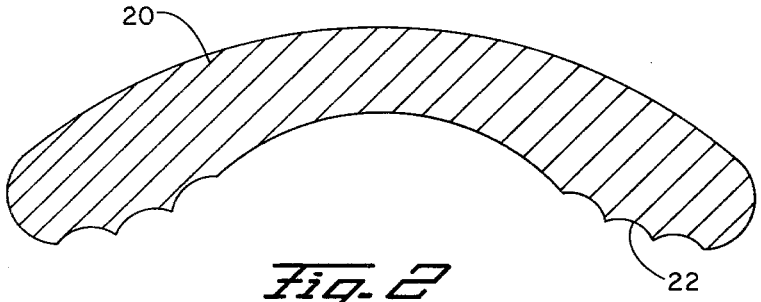
FIG. 2 is a partially schematic cross-sectional view of a prior art contact lens.
Figure 3A:
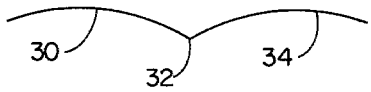
FIGS. 3*a* through 3*d* schematically represent the steps involved with the production of a bevel according to conventional practices.
Figure 3B:
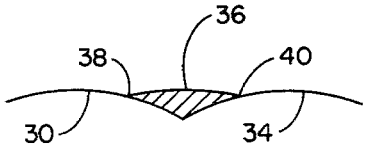
Figure 3C:
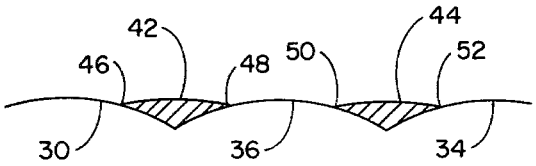
Figure 3D:
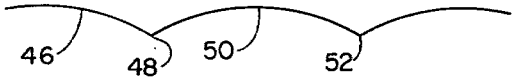

The apparatus and method to be discussed in detail below are unique and their application to the production of a lens, such as shown at 10 in FIG. 1 with a aspheric curve beginning at the optical periphery of the optical zone 12 of the lens and continuing in a progressively flatter manner until it reaches the apex of the edge 14, thus creating a bevel 16. The dimension 18, is the width of the bevel. The objective, of course, is to avoid beveling shortcomings as exemplified by bevel 22 on lens 20 of FIG. 2 and the multiple junctures exemplified at 46, 48, 50 and 52 in FIG. 3*d*.

Figure 4A:
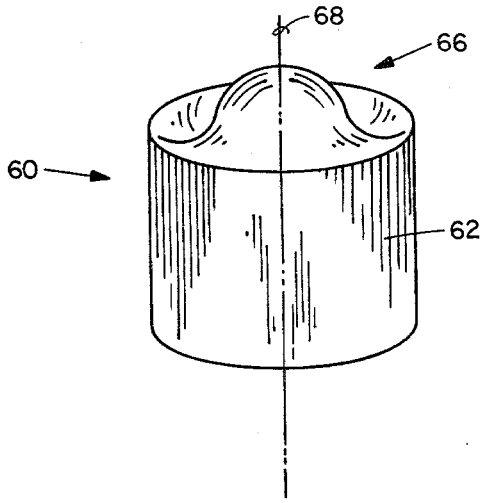
FIG. 4*a* is a perspective view of the novel apparatus of the instant invention.

Attention is directed to FIG. 4*a* which depicts an embodiment of the novel bevel-forming tool of the instant invention. Tool 60 comprises a main body portion 62 with a tapered or a threaded hole (not shown) on one end and a working surface 66 on the other. The tool 60 is designed to fit in any rotating mechanism used in lens manufacturing, and is thus most practically symmetrical about a central vertical axis 68. The working surface 66 has a topography that is essentially flattened in the central apexial area and at a predetermined point paracentral to that flattened central portion the aspheric curve begins.

Figure 4B:
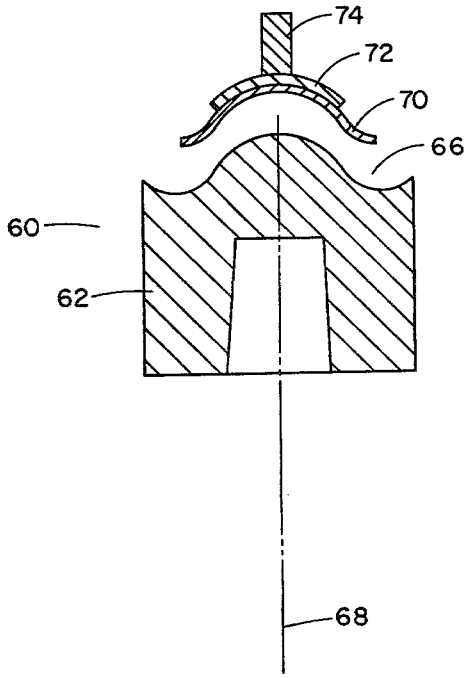
FIG. 4*b* is a cross-sectional view of the apparatus of FIG. 4*a*, including a lens and holder.

FIG. 4*b* is a vertical cross-section of the tool 60 of FIG. 4*a* with the addition of a schematic representation of a lens 70 and lens holder 72 in position just prior to the beginning of the beveling operation. The lens 70 is affixed to a cup like holder 72 by a sticky wax (not shown) or by other methods well known by those skilled in the art, which maintains the rigidity of the lens and provides sufficient adhesion to allow manual control of the lens via handle 74 during the grinding operation. The working surface 66 is, in conventional manner, covered with a thin layer of silk material or other suitable material which is held in place by an O-ring on the side of the tool body (since these elements are old in the art, they are not shown). Stannic oxide or some other suitable abrasive material is then placed upon the silk covered working surface. The tool 60 is then rotated about axis 68 and the lens 70 is brought into controlled contact with the working surface whereby the periphery of the lens is lapped or ground to conform to the contacted portion of the working surface.

One of skill in the art will readily realize that the optical zone of the lens should not be contacted by the rotating working surface. Thus, tool/lens compatability requires that the radius of the lens be greater than that of the spherical central portion of the working surface, such that the periphery of the lens may be properly ground while the optical zone remains spaced from the rotating tool.

The three dimensional contour of working surface 66 can be described as a smooth three-dimensional curvilinear surface configuration generated by the rotation of an S-shaped curve produced by the circumferential arcs of two tangential conic-section curves about a vertical axis. By reference to FIG. 4c this concept will be more easily understood. The circumferences of two tangential circles 80 and 82 with radii R1 and R2 respectively form a horizontal "figure eight". An S-shaped curve such as that designated 84 in the figure, can readily be laid out through the point of tangency. If the S-shaped curve so produced is rotated about a vertical axis through the apex 86 of the curve, the geometric figure of rotation thereby generated is representative of working surface 66.

Figure 4C:
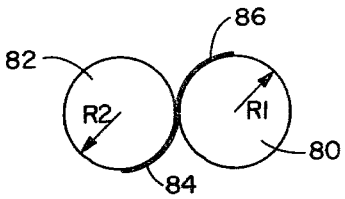
FIG. 4*c* is a diagramatic representation of a portion of the working surface of the tool shown in FIGS. 4*a* and 4*b* in which an S-shaped curve is produced by joining two circles.
Figure 4D:
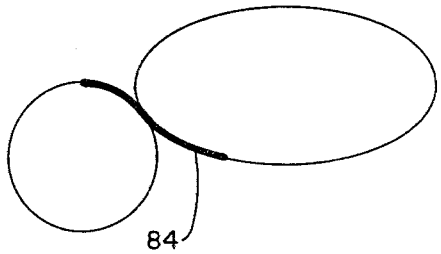
FIG. 4*d* is a diagramatic representation of a portion of the working surface of the tool shown in FIGS. 4*a* and 4*b* in which a circle and an ellipse are used to form the S-shaped curve.
Figure 4E:
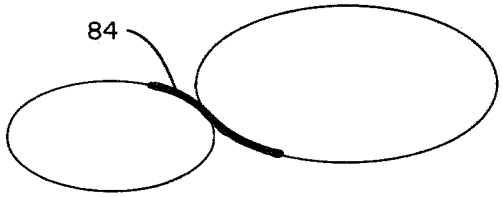
FIG. 4*e* is a diagramatic representation of a portion of the working surface of the tool shown in FIGS. 4*a* and 4*b* in which two ellipses are used to form the S-shaped curve.
Figure 4F:
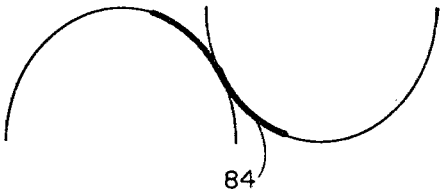
FIG. 4*f* is a diagramatic representation of a portion of the working surface of the tool shown in FIGS. 4*a* and 4*b* in which arcs of two parabolas are used to form the S-shaped curve.

In addition, it must be noted that not only circles with different or the same radius may be utilized as shown in FIG. 4c but also any two conic sections may be used such as shown in FIGS. 4d, 4c and 4f. In FIG. 4d, a cricle and an ellipse are used to form the S-shaped curve through the point of tangency. In FIG. 4e two ellipses are used and in FIG. 4f two parabolas are utilized which will produce the S-shaped curve 84. The S-shaped curve thus produced when rotated about a vertical axis through the apex 86 of the curve thereby describes a surface representative of working surface 66.

It is important to note when using circles that the radius' R1 and R2 may be infinitally varied to provide a range of tools from which the proper tool/lens relationship can be established.

The tool 60, or at least that portion thereof, making up the working surface 66, is most practically made of a machineable or moldable material such as plastic or brass. It has been found that the working surface can be readily formed on such materials on a lathe; however, there is no reason that other methods or materials would not prove satisfactory.

Finally, one of skill in the art will readily realize that when ordering the new non-spherical bevel, the fitter would provide the laboratory with all of the usual lens data, except the bevel radii (curves). The optical zone diameter of example could be specified to the nearest even increment of 0.5 mm available, beginning with 6.0, 6.5, 7.0, 7.5, and 8.0 mm. Of course, the bevel width can be figured if one knows the optical zone and the lens diameter. The bevel width data is not really necessary to have, although it is helpful in determining whether or not the bevel is too narrow. The optimum bevel width range is from 0.6 mm to 1.00 mm as shown in the following guidelines:

| LENS DIAMETER | O.Z. DIAMETER | BEVEL WIDTH |
|---|---|---|
| 7.4 | 6.0 | .7 |
| 7.6 | 6.0 | .8 |
| 7.8 | 6.5 | .6+ |
| 8.0 | 6.5 | .7+ |
| 8.2 | 6.5 | .8+ |
| 8.4 | 7.0 | .7 |
| 8.6 | 7.0 | .8 |
| 8.8 | 7.0 | .9 |
| 9.0 | 7.0 | 1.00 |
| 9.2 | 7.5 | .8+ |
| 9.4 | 7.5 | .9+ |

-continued

| LENS DIAMETER | O.Z. DIAMETER | BEVEL WIDTH |
|---|---|---|
| 9.6 | 7.5 | 1.00+ |

Although specific components, proportions and process steps have been stated in the above description of the preferred embodiments of the inventions, other suitable materials, proportions and process steps, as listed herein, may be used with satisfactory results in varying degrees of quality. In addition, it will be understood that various other changes of the details, materials, steps, arrangements of parts, and uses which have been herein described and illustrated in order to explain the nature of the invention will occur to and may be made by those skilled in the art, upon a reading of this disclosure, and such changes are intended to be included within the principles and scope of this invention.

I claim:

1. A method of producing a non-spherical bevel on the posterior surface of a contact lens comprising the steps of:

providing a rotatably mounted working surface having a central axis about which said working surface is symmetrical, said working surface further having a smooth three-dimensional curvilinear surface configuration generated by the rotation of an S-shaped curve produced by the circumferential arcs of two tantential conic-section curves about said central axis;

providing an abrasive material on said working surface;

rotating said working surface about said central axis; and bringing the posterior surface of the contact lens into contact with said working surface to selectively abrade away portions of the posterior peripheral surface thereof.

2. Apparatus for producing a non-spherical bevel on the posterior surface of a contact lens by rotationally abrading the lens, the apparatus comprising:

a body portion with a central axis and a working surface, said working surface being substantially symmetrical about said central axis and having a smooth three-dimensional curvilinear configuration generated by the rotation of an S-shaped curve produced by the circumferential arcs of two tangential conic-section curves about said central axis and means on said body portion in axial alignment with said central axis for affixing said body portion to rotation means.

3. The apparatus of claim 2 wherein:

said body portion comprises a rigid material.

4. The apparatus of claim 2 wherein:

said working surface is substantially circular in cross section.

5. The apparatus of claim 2 wherein:

said working surface is in the range of from about 5 mm. to about 12 mm. in diameter.

* * * * *